United States Patent [19]

Henderson

[11] 3,941,422

[45] Mar. 2, 1976

[54] METHOD OF INTERCONNECTING WELLS FOR SOLUTION MINING

[76] Inventor: John Keller Henderson, 4012 E. 41 Place, Tulsa, Okla. 74135

[22] Filed: May 20, 1974

[21] Appl. No.: 471,286

[52] U.S. Cl. ..... 299/4; 299/5; 299/16

[51] Int. Cl.[2] .....E21B 43/28; E21C 41/08; E21B 43/26

[58] Field of Search ..... 299/4, 5, 3, 16, 17; 166/271, 259, 308

[56] References Cited

UNITED STATES PATENTS

| | | | |
|---|---|---|---|
| 2,850,270 | 9/1958 | Hanson | 299/4 |
| 2,861,428 | 11/1958 | Hendrix | 299/4 X |
| 2,880,587 | 4/1959 | Hendrix et al. | 299/4 X |
| 3,003,557 | 10/1961 | Huitt et al. | 166/271 |
| 3,223,158 | 12/1965 | Baker | 166/259 |
| 3,329,207 | 7/1967 | Shock et al. | 299/4 |
| 3,405,974 | 10/1968 | Hundley, Jr. et al. | 299/4 |
| 3,433,530 | 3/1969 | Dahms et al. | 299/4 |

*Primary Examiner*—Stephen J. Novosad
*Attorney, Agent, or Firm*—Head, Johnson & Chafin

[57] ABSTRACT

A method of connecting wells for the purpose of producing salt by solution mining. Two wells are drilled into the salt bed, one of which is drilled in the conventional manner, that is, essentially vertically and the other of which is drilled from a point on the surface a selected distance from the first well and is deflected in the direction towards the conventional well so that the bottom of the deflected well approaches within a selected distance of the bottom of the conventional well. After the two wells are drilled the salt is fractured by the use of a conventional high pressure liquid fracturing technique in one or the other or both of the two wells, so that a fracture for fluid flow between the two wells will hopefully be obtained. Thereafter the salt is mined by flowing fresh water down one well and withdrawing saturated salt solution from the other well, the water passing from one well to the other through the fracture zone where it dissolves the salt, creating a cavity.

If it turns out to be impossible to form a fracture between the two wells, the deflected well is directionally drilled further towards the vertical well.

If the wells still do not connect each is independently solution mined, forming enlarged caverns. When the caverns coalesce the formation can be mined by pumping fresh water down one well and removing concentrated brine from the other.

3 Claims, 1 Drawing Figure

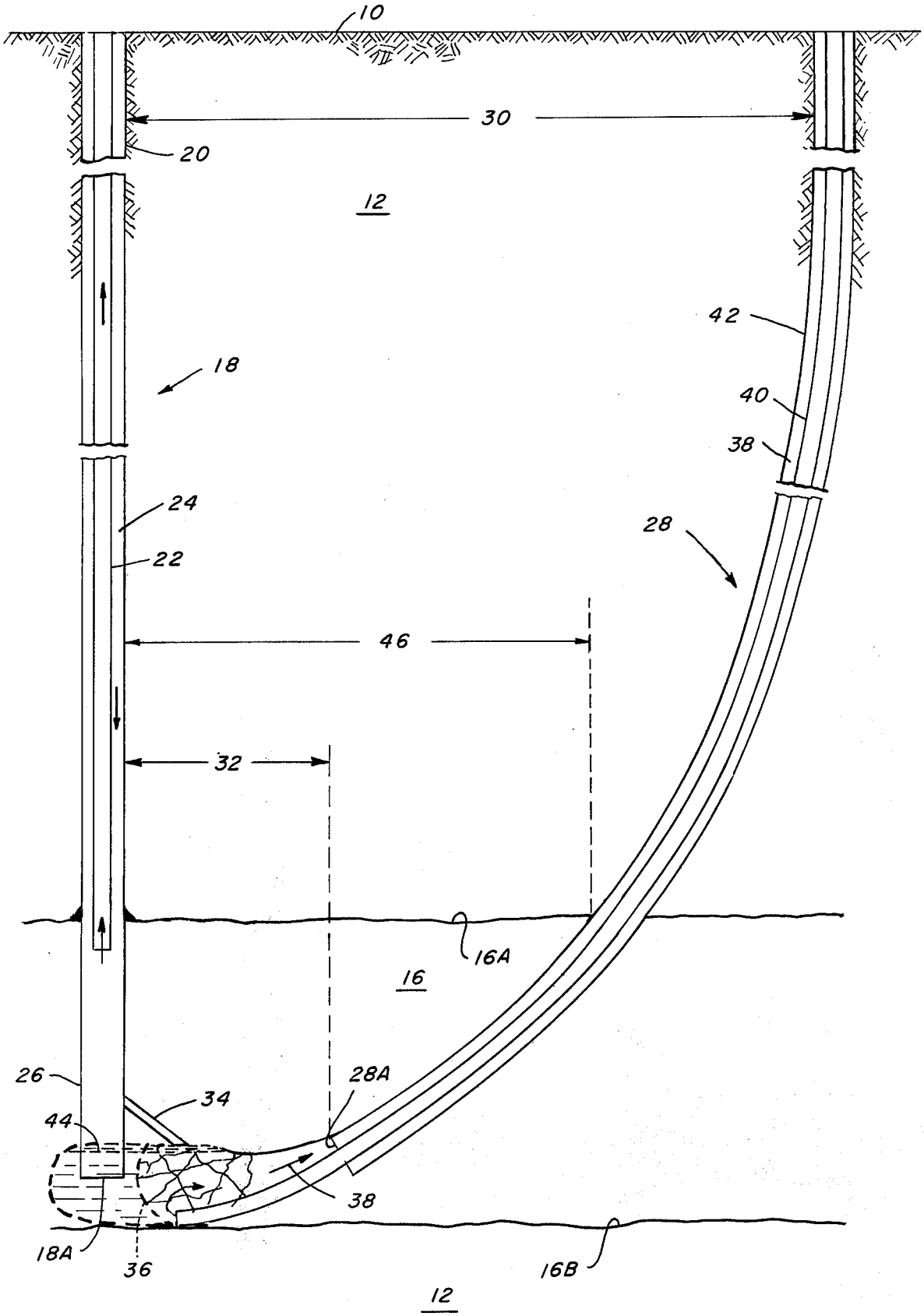
10
30
20
12
42
18
40
38
24
28
22
46
32
16A
16
26
28A
34
44
38
18A
36
16B
12

METHOD OF INTERCONNECTING WELLS FOR SOLUTION MINING

BACKGROUND OF THE INVENTION

This invention is in the field of salt recovery by means of solution mining. More particularly, it involves an improved method of connecting wells for salt production where a greater proportion of the salt present in the formation can be recovered efficiently.

The original method of producing salt by solution mining was to drill a vertical hole from the surface into the salt bed, pump fresh water in through the casing annulus, contacting the fresh water against the salt along the walls of a cavity formed at the base of the well and discharge brine up the tubing to the surface.

Another known method is to drill two spaced apart conventional vertical wells into a salt formation. Solution mining is employed in each well, creating cavities. Oil is introduced into each cavity which forms a nonsoluble pad in the upper surface of each cavity. This causes the cavities to form more rapidly in horizontal directions. The flattened cavities grow in size until they coalesce, that is, join together, at which time the formation can be mined by pumping fresh water into one well and removing brine from the other. This method has the disadvantage that both wells must be completed for individual mining operation and the process to achieve coalescence is slow.

Still another method is to drill two conventional vertical wells spaced apart from each other. One or both of the wells are fractured by high pressure by the known procedure frequently employed by the petroleum industry. If the fracture operation opens up a flow passageway between the two wells, water can then be pumped down one well and brine removed from the other. The problem with this method is that there is no way to control the direction of fracture. Therefore, to have a good degree of success the wells must be drilled closer together. If the wells are drilled close enough together to insure connection by fracturing, the resulting cavity formation is small and the total salt recovery reduced.

SUMMARY OF THE INVENTION

It is a primary object of this invention to provide a method of well connection for solution mining. This and other objects are realized and the limitations of the prior art are overcome in this invention by the use of two wells drilled from the surface down to the salt formation. One of the wells is drilled vertically (conventionally). The other is drilled from a point displaced on the surface by a selected distance. This well is deflected as it is drilled, in the direction towards the conventional well. The base of the deflected well will approach within a selected distance of the base of the conventional well. The salt formation is fractured by use of a high pressure liquid, such as saturated salt solution, in one well, or the other, or in both wells, in order to hopefully obtain a fracture which will tie together the bases of the two wells.

If the fracture attempt is unsuccessful it is not possible to flow water into one well and brine out the other. This problem is overcome by drilling the deflected well further towards the bottom of the conventional well. One or both of the wells are again fractured, hoping to interconnect them. If interconnection is not received, the wells are individually solution mined, forming cavities. When the cavities grow until they coalesce the salt may be mined by pumping fresh water down one well and brine out the other.

The deflected well is preferably drilled in such a way that the bottom segment is as near horizontal as possible and as near the bottom of the salt formation as possible. This allows the withdrawal tubing of the deflected well to remain on the bottom as the salt is removed without the necessity of constantly lowering the well tubing and without the problem of the tubing being broken off by cave-in's as the formation is mined.

BRIEF DESCRIPTION OF THE DRAWINGS

The objects and advantages of this invention and a better understanding of the principles and details thereof will be evident from the following description taken in conjunction with the appended drawing which shows a vertical cross-sectional view through the earth in a plane passing between two wells.

DESCRIPTION OF THE PREFERRED EMBODIMENT

Referring now to the drawing there is shown the surface 10 of the earth 12 and a vertical cross sectional view of the earth down to a depth which includes the presence of a salt formation 16. The top of the salt formation is indicated by 16A and the bottom of 16B.

The normal procedure is to drill a conventional vertical well (generally indicated by the numeral 18) downward to the salt formation 16. A casing 20 is positioned in the drilled well. Tubing 22 is placed in the casing 20. Fresh water is pumped from the surface down through the annulus 24 between the tubing 22 and casing 20. The fresh water will contact the salt, dissolving it and forming a cavity and will flow back up, in accordance with the arrow through the tubing 20 to the surface. The process can be reversed, that is, fresh water can be pumped down the tubing 22 and brine up the annulus 24. The saturated salt solution is then refined in a process which is well known in the art to obtain the dissolved salt.

The problems with efficient solution mining salt by means of a vertical well include: (1) The rate of injection must be limited because a fast rate will result in short circuiting of the water, causing unsaturated brine to be returned to the surface; (2) The tubing 22 must be periodically lowered or replaced to maintain the efficiency of the solution mining process; and (3) as salt is dissolved cave-in's occur which frequently break off the tubing 22, thus the well must be worked over to repair or replace the broken tubing.

As previously mentioned, improved techniques include the practice of drilling two wells, interconnecting the bottoms of the wells in the salt formation, pumping fresh water down one of the wells and removing brine from the other. Two methods of interconnecting the bases of the two wells have been discussed above and their limitations and disadvantages mentioned.

In this invention two wells are drilled. One indicated by 18 is drilled conventionally in accordance with the previous description. Another well (generally indicated by the numeral 28) is displaced at the surface by some considerable distance 30 from the conventional well. The lower portion of well 28 is drilled at a deflected angle in the direction towards the conventional well, that is, as the base of the deflected well 28 moves downwardly it moves toward the base of the conventional well 18 and approaches within a selected distance 32. This distance 32 is selected so that it will increase the possibility of successfully using hydraulic fracturing techniques to create a fissure or fracture between the bottom 18A of the conventional well and the bottom 28A of the deflected well. Fracturing may be attempted in the conventional well 18, the deflected well 28, or in both wells. A successful fracture is indicated at 34.

If the fracture 34 is obtained between wells 16 and 28 the salt strata 16 can be mined by flowing fresh water down one well and brine out the other. However, with present technology there is no way to control the direction a fracture or fractures will take. It is therefore sometimes impossible to intersect the deflected well 28 by a fracture from conventional well 16.

If the fracture step does not interconnect the wells the deflected well is drilled further towards the bottom 18A of the conventional well.

As an alternative, the deflected well may be solution mined to extend the cavity 36 in the direction towards the bottom of well 18. To insure the fresh water introduced into the formation through tubing 40 forms a cavity which primarily grows in the horizontal rather than the vertical direction, oil may be introduced in the cavity. The oil forms an upper layer or pad 44. Since salt is not rapidly dissolved by oil and the oil shields the salt from fresh water, the cavern 36 extends horizontally rather than vertically.

After the deflected well is drilled further towards the conventional well, or the cavity of the deflected well is formed, the conventional well may again be fractured.

The formation of cavity 36 has two beneficial effects. First, the cavity reduces the distance between the wells, thereby increasing the chance that a fracture will interconnect the two wells. In addition and of more importance, the cavity 36 provides a much larger target than the relatively small diameter, usually 12 inches or less, of the drilled well 28.

If interconnection is achieved, the wells are utilized by pumping fresh water down one and brine out the other as previously described. If, after the formation of cavity 36 followed by fracturing of well 18, no interconnection results, the wells can be individually solution mined using in each an oil pad 44, until the cavities formed around each well grows so large that they coalesce with each other.

Another feature of this invention is that by flowing fresh water through the tubing 40 of the deflected well 28 and directing it more or less in a horizontal direction, an elongated narrow cavity is formed in the direction towards the conventional well. Thus, it is possible to make the initial distance 32 somewhat larger than desired and to extend the well, so to speak, by solution mining a more or less cylindrical cavity in the direction of the conventional well 18.

The sequence of steps typically employed in practicing the invention are as follows:

1. Conventional well 18 is drilled, the portion 26 extending into the salt formation 16.

2. The deflected well 28 is drilled. The deflected well may be spaced from the conventional well so that distance 30 is about 800 feet at the surface. It is understood that the deflected well 28 may be drilled first and then conventional well 18 second, since the sequence of drilling the two wells is immaterial.

3. Deflected well 28 is drilled vertically until it is approximately 900 feet from the bottom 16B of salt formation, at which time directional deflected drilling is initiated.

4. Deflected drilling in the direction towards the bottom of conventional well 18 is continued. While the specific rate of deflection may vary it has been found that a deflection of approximately six degrees per one hundred feet of drilling is satisfactory.

5. The deflected well 28 is drilled after deflection is initiated approximately 1,400 measured feet. This places the lower end 28A of the deflected well approximately 22 feet above the bottom of the salt formation 16B and approximately 100 feet from the bottom of the target well 18A.

6. Pipe is set in both wells.

7. Fracturing of the wells is attempted. Fracturing may be employed in conventional well 18 or in deflected well 28 or may be employed in both wells either simultaneously or sequentially.

8. If a fracturing connection is completed between the wells the coalescence of the wells is complete and salt may be solution mined as previously described, that is, by flowing fresh water in one well and withdrawing brine from the other.

9. If step 7 does not result in connection of the wells drilling of the deflected well 28 is continued for approximately 100 feet, or until the bottom of the formation 16B is encountered. If the direction of drilling of the inclined well 28 is perfect this should put the bottom of the deflected well directly under the bottom of conventional well 18. However, directional drilling is seldom perfect and because of the relatively large distance (800 feet as an example as above stated) between the wells initially, it is seldom that the wells will interconnect by drilling alone.

10. As an alternative to increased directional drilling of deflected well 28, the well may be solution mined, using an oil pad 44 to extend the cavity 36 towards the bottom of conventional well 18.

11. One or both of the wells may again be fractured in an attempt to connect them. However, if conventional well 28 has been solution mined to extend cavity 36 only conventional well 18 will be fractured since it is undesirable to attempt a fracture operation out of a cavern. If connection is now made the process is completed and the salt may be mined as above indicated.

12. If step 11 does not result in the connection of the wells the deflected well 28 is solution mined or both wells may be individually solution mined until they coalesce. To improve the chances of connection by solution mining, oil padding may be employed. This is done by introduction of oil into the cavities so that each cavity will form horizontally rather than vertically and thereby increase the chance of coalescence. Solution mining is continued until the wells coalesce.

The invention achieves several improvements over the known processes previously discussed. First, it enables wells which are to be joined together at the bottom to be spaced further apart. This means that the distance 46 between the wells at the top 16A of the salt formation is relatively much greater. Since salt is dissolved primarily in the upper portion of a cavity, that is, a cavity formed by solution grows in the upward rather than the downward direction, the total potential salt recovery by use of the two wells is increased compared to that which would be achieved by two vertical wells separated only by distance 32.

The second advantage is that the tubing 40 in the deflected well 28 lies at or near the bottom in a substantially horizontal plane which minimizes the chance of being broken off by cave-ins.

A third advantage is that increased chance is obtained for interconnecting wells at a minimum of time and expense.

Nothing has been shown of the surface equipment required to do the pumping and handling of the liquids and handling of the fracturing operation. However, since this is well known in the art and forms no part of this invention, no further description is required.

While this invention has been described in terms of the solution mining of salt this is only by way of example and the method can be applied to the mining of other soluble chemical elements or compounds, such as sulfur, tar, (as in the tar sands), etc. The invention may also be usefully employed in the formation of caverns for use in underground storage of liquids.

While the invention has been described with a certain degree of particularity it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed is:

1. The method of producing a soluble chemical material by solution mining a subterranean formation thereof, comprising:

a drilling a conventional well into the formation;

b directionally drilling a deflected well, displaced by a selected distance at the earth's surface from said conventional well, said deflected well being directed toward said conventional well so that the bottom thereof approaches within a selected distance of the bottom of said conventional well in said formation;

c solution mining said deflected well to form a cavern in the formation to decrease the distance between the well bottoms;

d fracturing the formation between the bottoms of said two wells to achieve a liquid flow connection between said two wells; and e flowing a solvent down through one of said wells and a solution out the other of said wells.

2. The method as in claim 1 in which said formation comprises salt and said solvent is water.

3. The method as in claim 1 including the step of introducing oil in said deflected well while it is being solution mined in step (c) so that the cavern grows primarily horzontaly.

* * * * *